US008087795B2

(12) United States Patent
D'Amato

(10) Patent No.: US 8,087,795 B2
(45) Date of Patent: Jan. 3, 2012

(54) FLASHLIGHT HOLDER AND ASSEMBLY

(76) Inventor: David E. D'Amato, Wake Forest, NC (US)

( * ) Notice: Subject to any disclaimer, the term of this patent is extended or adjusted under 35 U.S.C. 154(b) by 309 days.

(21) Appl. No.: 12/413,997

(22) Filed: Mar. 30, 2009

(65) Prior Publication Data

US 2010/0246167 A1 Sep. 30, 2010

(51) Int. Cl.
*F21V 33/00* (2006.01)

(52) U.S. Cl. ..... 362/109; 362/190; 362/197

(58) Field of Classification Search ..... 362/109, 362/110, 113, 114, 190–191, 197
See application file for complete search history.

(56) References Cited

U.S. PATENT DOCUMENTS 5,167,446 A 12/1992 Haroutunian
5,580,157 A * 12/1996 Patricca et al. ..... 362/191
5,848,834 A 12/1998 Kerr
6,641,277 B2 * 11/2003 Smith ..... 362/111
7,303,306 B2 12/2007 Ross et al.
7,731,380 B2 * 6/2010 Wu ..... 362/113

* cited by examiner

*Primary Examiner* — Robert May
(74) *Attorney, Agent, or Firm* — Coates & Bennett, P.L.L.C.

(57) ABSTRACT

A flashlight assembly provides a convenient ability to turn the flashlight on and off, particularly for flashlights with a pressure activated power switch disposed on a rear portion of the flashlight. In one version, the flashlight assembly includes a flashlight holder that has a housing for receiving the flashlight's rear portion therein. The flashlight holder also has a handle connected to the housing that includes a support arm and an actuator arm. The support arm extends outwardly from the housing, while the actuator arm extends from the support arm back toward the housing, so as to overlie the power switch in spaced relation thereto. Disposed in this manner, the actuator arm is movable between depressed and released configurations. This movement allows the power switch to be selectively depressed and released, so as to turn the flashlight on and off. Other versions and methods are also disclosed.

20 Claims, 3 Drawing Sheets

FLASHLIGHT HOLDER AND ASSEMBLY

BACKGROUND

The present invention is directed generally to a flashlight holder, and more particularly to a flashlight holder that allows convenient activation and de-activation of the associated flashlight.

The handles of conventional flashlights are often sized and shaped such that it is difficult to use the hand holding the flashlight for any other purpose. That is, such flashlights typically required that the entire hand be used to grasp the flashlight. Thus, for example, the hand holding the flashlight cannot be used to simultaneously hold a handgun in a two-handed grip, or to simultaneously hold a pet leash, etc.

Various flashlight holders and assemblies have been proposed to address this deficiency. However, prior art flashlight holders typically require a user to grasp the flashlight holder at a location that makes it inconvenient to turn the flashlight on and off and/or are otherwise complicated and cumbersome to use. Thus, while various approaches to supporting a flashlight have been proposed, they have not proven satisfactory for all situations. Accordingly, there remains a need for alternative flashlight holders and assemblies.

SUMMARY

In one embodiment, the flashlight assembly of the present invention includes a flashlight that has a rear power actuating end with a pressure activated power switch for turning the flashlight on and off. The flashlight assembly also includes a flashlight holder for receiving the flashlight therein. More specifically, a housing of that flashlight holder has a bore extending along an axis. The bore is sized and configured to receive at least the rear end of the flashlight therein. The flashlight holder includes a handle, connected to this housing, that includes a support arm and an actuator arm. The support arm extends outwardly from the housing, while the actuator arm, in turn, extends from the support arm back toward the housing. That is, the actuator arm has a distal end portion that joins to the support arm distally from the housing and a proximal end portion disposed proximally, and in spaced relation, to the housing. Accordingly, with the rear end of the flashlight received in the bore of the housing, the actuator arm overlies the power switch of the flashlight (at least when viewed from a direction along the above-mentioned axis).

The actuator arm is movable between a first depressed configuration and a second released configuration for conveniently turning the flashlight on and off. In the depressed configuration, the proximal portion is relatively closer to the power switch than in the released configuration. The movement of the proximal portion of the actuator arm allows the power switch to be selectively depressed and released, so as to turn the flashlight on and off.

Provided with such a flashlight assembly, operation of the flashlight includes coupling the flashlight to the flashlight assembly. Such coupling may entail, for example, inserting a rear portion of the flashlight into the flashlight holder bore. Once coupled, a palm and one or more fingers of a hand compress the handle therebetween to move (e.g., deflect) the proximal portion of the actuator arm toward the bore. This movement, as described above, depresses the power switch disposed on the rear portion of the flashlight, and, responsive thereto, changes the on/off state of the flashlight. If desired, the flashlight may be subsequently removed from the bore for independent operation.

In another embodiment, a flashlight assembly comprises a housing extending along an axis; a light emitter supported by the housing and oriented to emit light generally along the axis; and a switch operative to control the light emitter. A handle is connected to the housing and comprises: a support arm extending outwardly from the housing; an actuator arm supported by the support arm and extending toward the housing, the actuator arm having a distal end portion supported by the support arm at a location distal from the housing and a proximal end portion disposed in spaced relation to the housing so as to overlie the switch when viewed from a direction along the axis. The actuator arm is movable between a first depressed configuration where the proximal end portion is relatively closer to the housing and a second released configuration where the proximal end portion is relatively farther from the housing.

The various aspects of the illustrative embodiments of the invention may be used alone or in any combination, as is desired.

DETAILED DESCRIPTION

The present application is directed to a flashlight holder for supporting a flashlight, and related assemblies and methods. The flashlight holder advantageously provides support of a flashlight while also providing a convenient means for turning the flashlight on and off.

Figure 1B:
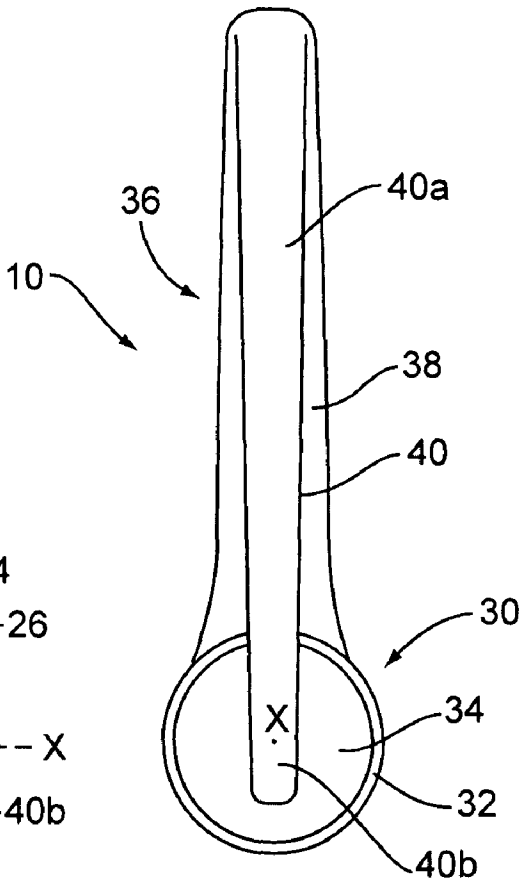
FIG. 1B shows a cross-sectional view of the flashlight holder of FIG. 1A with the flashlight removed therefrom.
Figure 1A:
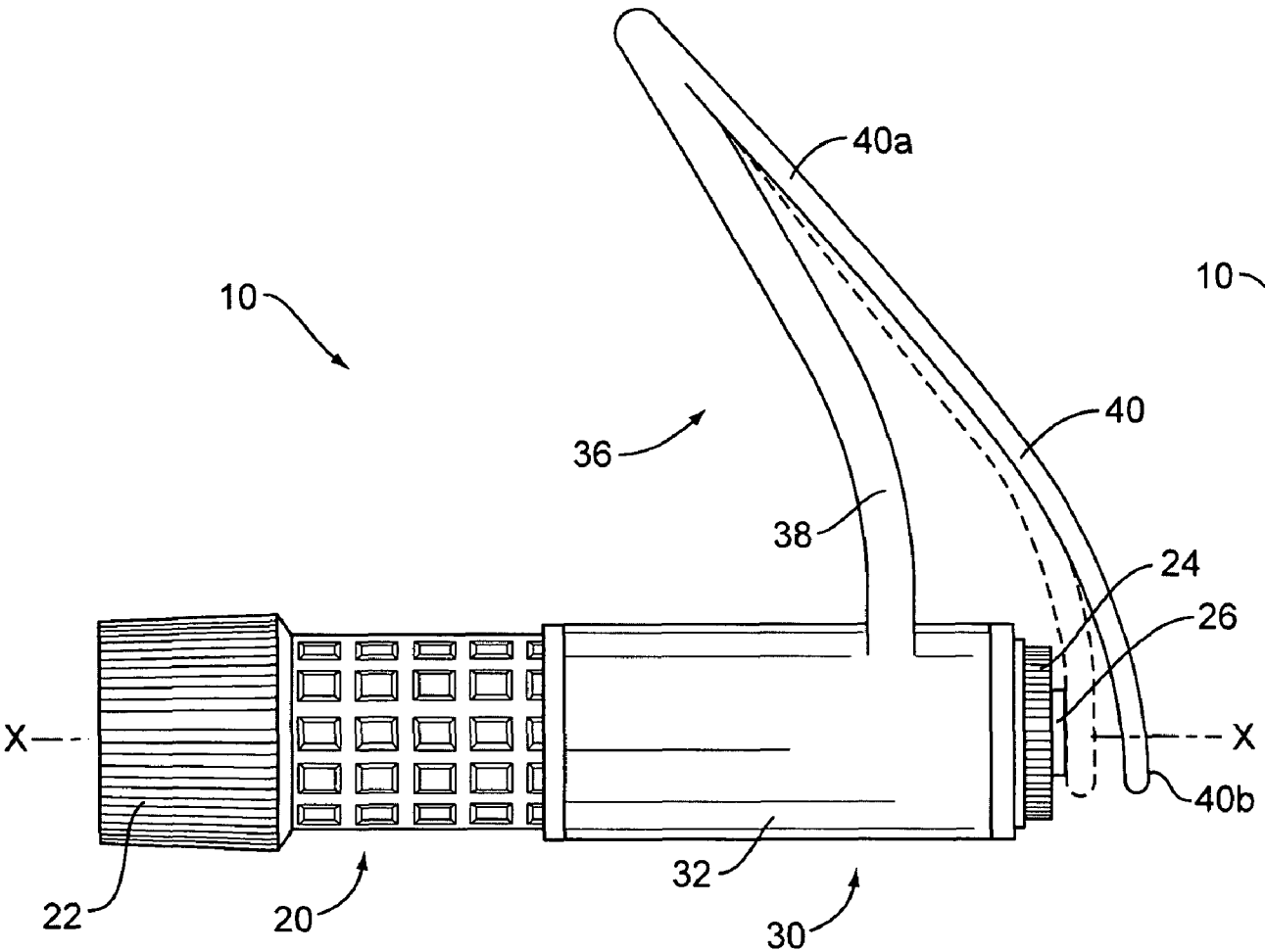
FIG. 1A shows a side view of a flashlight assembly according to one embodiment of the present invention in the assembled condition.

FIG. 1A shows an illustrative embodiment of a flashlight assembly, generally indicated at 10, according to the present invention. The flashlight assembly 10 includes a flashlight 20 and a flashlight holder 30. As is conventional, the flashlight 20 has a generally cylindrical overall shape with a front portion 22 and a rear portion 24. The front portion 22 includes a light source such as a light bulb, LED, or the like (not shown) which emits light generally along the longitudinal axis of the flashlight 20. The on/off state of the light source is controlled by a suitable power switch 26. The rear portion 24 typically houses the battery or batteries (not shown) and the power switch 26. As will be discussed further below, at least the flashlight rear portion 24 is disposed in and supported by the flashlight holder 30 such that the flashlight holder 30 is able to support the flashlight 20 in a desired orientation. The exterior of the flashlight 20 may be suitably textured to increase ease of gripping, and may be either rigid or cushioned, as is desired.

Flashlight holder 30 includes a housing 32 and an handle 36 connected to the housing. The housing 32 has a bore 34 that extends along a corresponding longitudinal axis X. The bore 34 is sized and configured to receive at least the flashlight rear portion 24 therein so that the longitudinal axis of the flashlight is advantageously aligned with axis X. Advantageously, the flashlight 20 is insertable into the bore 34 such that some of the flashlight rear portion 24 extends rearwardly out of the bore 34 (e.g., at least the power switch 26). See FIG. 1A.

The handle 36 of flashlight holder 30 includes a support arm 38 extending outwardly from housing 32 and an actuator arm 40 joined to the support arm 38. In a preferred embodiment, the actuator arm 40 includes a distal end portion 40*a* and a proximal end portion 40*b* (with proximal and distal in this case being relative to the housing 32), and connects to the housing 32 via the support arm 38. The distal end portion 40*a* joins to the support arm 38 at a location therealong that is distal from the housing 32. This connection may be a fixed connection or an articulating connection (e.g., hinge), as is desired. The proximal end portion 40*b* is supported in cantilever fashion from the distal end portion 40*a* so as to be in spaced relation to bore 34. As shown in FIGS. 1A-1B, the actuator arm 40 extends (downward in FIG. 1A) from its joint with the support arm 38 toward the housing 32 so that the support arm proximal end portion 40*b* overlies the bore 34 when viewed from a direction along the axis X, but is longitudinally spaced from the bore 34. Thus, the housing 32, support arm 38, and actuator arm 40 together form a somewhat zig-zag pattern when viewed from the side.

The actuator arm 40 is movable between a depressed configuration and a released configuration. In the depressed configuration, shown in dashed lines in FIG. 1A, the proximal end portion 40*b* of the actuator arm 40 is relatively closer to the housing 30 and associated bore 34. In the released configuration, shown in solid lines in FIG. 1A, the proximal end portion 40*b* is relatively farther from the housing 30 and associated bore 34. This movement of the proximal end portion 40*b* allows switch 26 to be selectively depressed and released, so as to turn the flashlight 20 on and off, as discussed further below. When the proximal end portion 40*b* is in the released configuration, there may be light contact between the proximal end portion 40*b* and the switch 26 (when the flashlight 20 is present in the bore 34) in some embodiments; however, the proximal end portion 40*b* is advantageously spaced from switch 26 in the released configuration. The proximal end portion 40 is biased away from the bore 34, either by the inherent flexural stiffness of the actuator arm 40 or by other means, such as separate hinge spring or the like.

In some embodiments, power switch 26 is of a momentary pressure-activated type. For these embodiments, moving the actuator arm 40 into the depressed configuration causes switch 26 to be depressed, thereby turning on the flashlight 20. Conversely, moving the actuator arm 40 into the released configuration causes switch 26 to be released, thereby turning off the flashlight 20. In other embodiments, power switch 26 may be of a toggle type. For these embodiments, moving the actuator arm 40 into (or out of, depending on the switch type) the depressed configuration causes the switch 26, and thus flashlight 20, to toggle between on and off states.

To use the overall device 10, a user couples the flashlight 20 to the flashlight holder 30 by inserting the flashlight rear portion 24 into the bore 34. Typically, the user inserts the flashlight rear portion 24 substantially through the bore 34 so that the power switch 26 advantageously extends rearwardly out the bore 34, as discussed above. The user then grasps the handle 36, in one embodiment, without using his or her entire hand. Specifically, the user wraps his or her fingers around the front of the support arm 38 and rests his or her palm on the back of the actuator arm 40 (e.g., in FIG. 1A, at some point below the actuator arm's joint with the support arm 38). Grasping the handle 36 in this manner permits the user to grasp another item, placed near the front of the support arm 38, with his or her fingers. This grip also permits the user to conveniently activate or de-activate the flashlight 20 by simply tightening or loosening his or her grip on the handle 36. That is, the user holds his or her fingers and palm tightly around the handle 36 (thereby deflecting the proximal portion 40*b* toward switch 26) to move the actuator arm 40 into the depressed configuration. Conversely, the user holds his or her fingers and palm loosely around the handle 36 (thereby allowing the proximal portion 40*b* away from switch 26) to move the actuator arm 40 into the released configuration. If desired, the user may at some point thereafter remove the flashlight 20 from the bore 34 so that the flashlight 20 can be used in a conventional independent manner or so that the flashlight holder 30 can be used with a different flashlight 20.

Being able to conveniently turn the flashlight 20 on and off as described above is particularly useful when holding the flashlight assembly 10 and another item with the same hand. These other items may be preferably held with one hand (e.g., a pet leash) or with both hands (e.g., a handgun). Indeed, the present invention finds particular utility in a law enforcement environment. Typically, law enforcement officers are taught to grasp a firearm with both hands in a two-handed grip. At night, or in low light situations, the officer must at the same time also hold a flashlight to illuminate potential targets. Various prior art flashlight holders address this issue and allow a user to hold an item with a two-handed grip, while also holding a flashlight. These prior art flashlight holders, however, require the user to locate and physically depress a small power switch with the user's finger. Particularly in high intensity law enforcement situations, these prior approaches may consume an unacceptable amount of time or attention to activate or de-activate the flashlight. In contrast, the present invention only requires the user to tighten or loosen his or her grip of the handle 36. This advantageously results in faster control of the flashlight 20 and also prevents the user from compromising his or her grip of the handgun or other item.

Figure 2B:
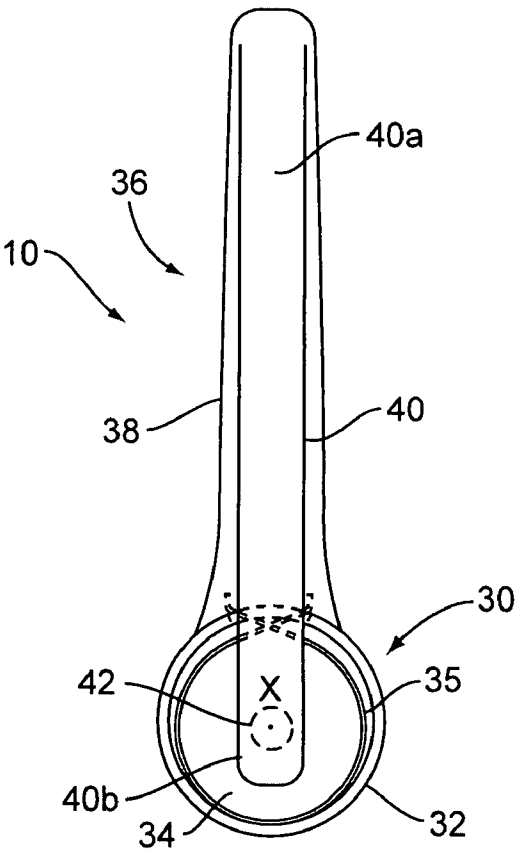
FIG. 2B shows a cross-sectional view of a flashlight holder of the embodiment of FIG. 2A.
Figure 2A:
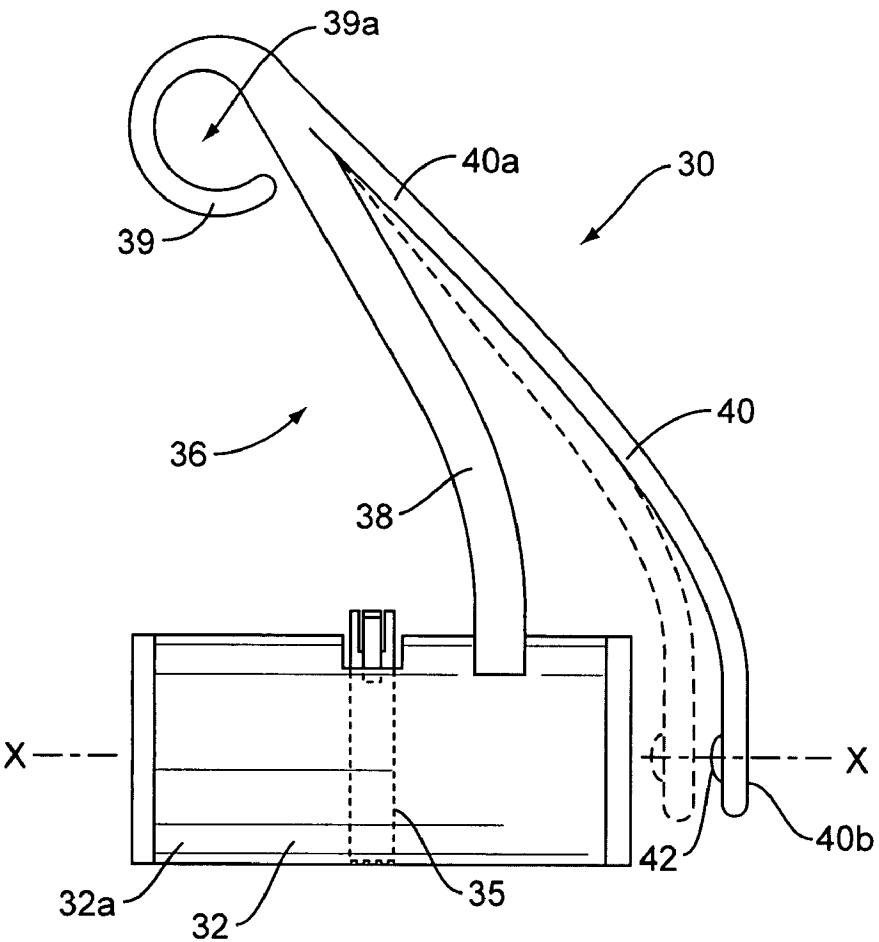
FIG. 2A shows a side view of a flashlight holder according to another embodiment of the present invention.
Figure 2C:
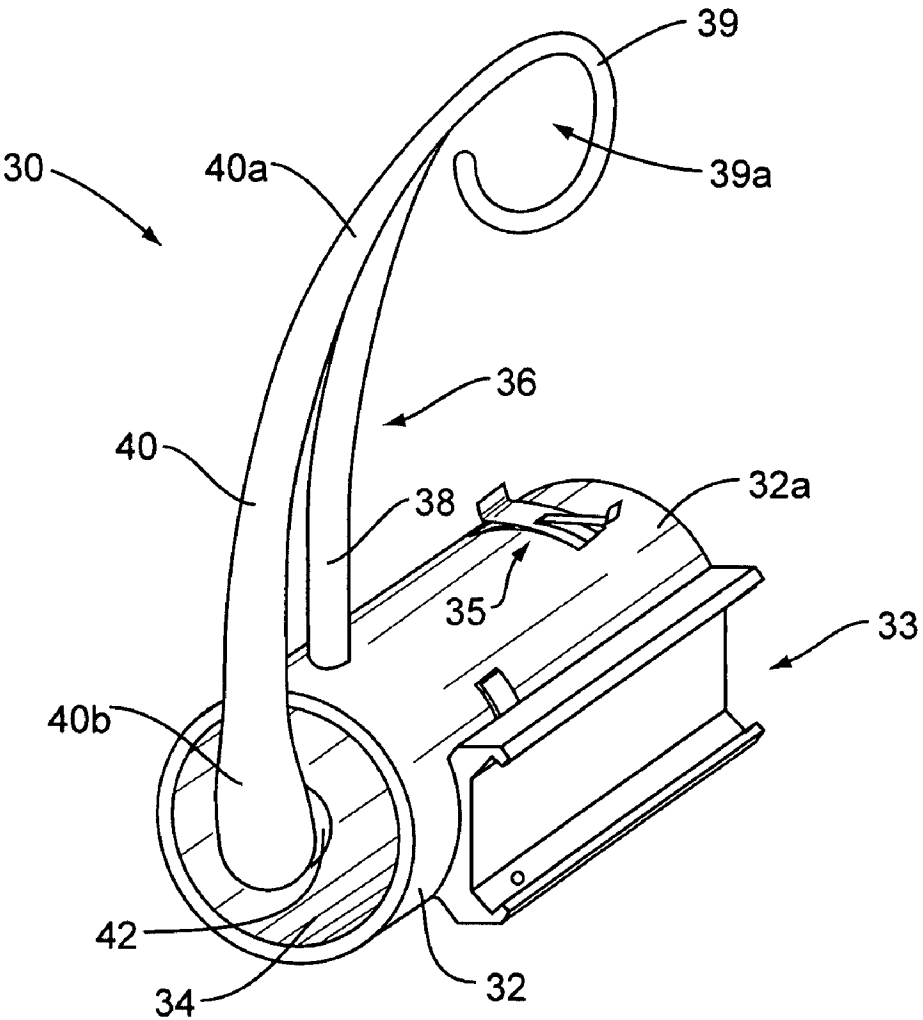
FIG. 2C shows a perspective view of a flashlight holder of the embodiment of FIG. 2A.

Further, to facilitate the use during such situation, the flashlight assembly 10 may optionally be mountable to an item such as a handgun. In FIGS. 2A-2C, the housing 32 includes a mounting rail 33 for attaching the flashlight holder 30 and a firearm (not shown). In this embodiment, the mounting rail 33 is a so-called Picatinny rail or other standardized mounting mechanism for releasably mounting accessories to firearms. The mounting rail 33 may be advantageously angled relative to the handle 36, such as at an approximately 90° angular offset, so that the handle 36 does not interfere with attachment to the firearm.

Of course, the present invention also finds application in other situations. For example, a user may wish to carry the flashlight 20 and a pet leash in the same hand. The present invention allows such to occur and provides an easy and simple method of selectively turning the flashlight on and off without having to engage two hands.

FIGS. 2A-2C also illustrate additional features of the present invention that are independently advantageous. In one embodiment, the proximal portion 40*b* of the actuator arm 40 includes a protrusion disposed toward a forward portion of the housing 32. The protrusion 42 helps focus the force applied by the actuator arm 40 against the switch 26. In FIG. 2A, for example, the actuator arm 40 includes a protrusion 42 in the form of a simple bump on the forward side of the proximal portion 40*b*. Advantageously, this protrusion 42 is aligned with the axis X, as shown in FIG. 2B, but this is not strictly required.

FIG. 2B also illustrates the housing 32 having means for securing the flashlight 20 in the bore 34. As shown, these securing means include a clamp 35 disposed in the bore 34. The clamp 35 has tabs exposed outside the housing 32. When the tabs are pressed together, the diameter of the clamp 35 increases so as to permit the flashlight rear end 24 to be inserted therein. When the tabs are released, the diameter of the clamp 35 decreases and secures the flashlight rear end 24 within the bore 34. So secured, the flashlight rear end 24 remains within the bore 34 even when the actuator arm 40 applies a force against the switch 26. Other securing means may also independently or in combination secure the flashlight rear end 24 within the bore 34. These include, for example, deformable cushion material on the interior of the bore 34, and/or tapering of the bore 34 along the axis X, and/or other clamping, gripping, or retaining means such as hose clamps, retaining pins, and the like.

The support arm 38 may, as illustrated in FIG. 2A, have a finger loop 39 located distal from the housing 32. This finger loop 39 provides additional stability and support of the flashlight assembly 10, especially if the assembly 10 shifts forward or backward during use. When, for example, a user's index finger is inserted into the finger loop's opening 39*a*, the user can more securely grasp the handle 36. As shown, the finger loop opening 39*a* is oriented generally perpendicular to the axis X so that a user's finger can be naturally inserted therein when grasping the handle 36 as described above.

The handle 36 may also be ergonomically curved so that the user can more comfortably grasp the handle 36. The radius of curvature may further facilitate the user's grasping of another item. FIG. 2A, for example, shows the handle 36 curved forward relative to the housing 32, in general alignment with axis X. When grasping the handle 36 in the same manner as described above, the handle's curvature allows the user to more comfortably and conveniently grasp another item using his or her fingers. Of course, the user may continue to rest his or her palm on the actuator arm 40 for conveniently turning the flashlight 20 on and off.

In some embodiments, the actuator arm 40 is supported in cantilever fashion from the support arm 38 via a non-articulating joint, and is deflected between the depressed configuration and the released configuration. In other embodiments, the actuator arm 40 may be pivotally supported by the support arm 38 via a pivot pin or the like, and biased toward the released configuration. Further still, some embodiments may employ a trigger type actuator, for example on the forward face of support arm 38, that is coupled to the actuator arm via suitable linkage so that depression of the trigger causes movement of the actuator arm toward the housing. Further, while the above description referred to various portions of the flashlight assembly 10 as if they were separate parts that are joined, these portions may be integrally formed together. For example, the support arm 38 may be integrally formed with the housing 32.

The discussion above has been in the context of a flashlight 20 that is removably mated to the flashlight holder 30. However, in some embodiments, the flashlight may be permanently mated to and/or integrally formed with the holder 30. For example, the housing 32 of flashlight assembly 10 may be elongated along axis X or otherwise directly house the electronics for generating light, with the generated light emitted generally along axis X.

The present invention may, of course, be carried out in other specific ways than those herein set forth without departing from the scope of the invention. The present embodiments are, therefore, to be considered in all respects as illustrative and not restrictive, and all changes coming within the meaning and equivalency range of the appended claims are intended to be embraced therein.

What is claimed is:

1. A flashlight holder, comprising:

a housing having a bore extending along a bore axis, the bore sized and configured to receive a flashlight therein; and a handle connected to the housing and comprising:

a support arm extending sideways and outward from the housing and having a longitudinal centerline oriented non-parallel to the bore axis;

an actuator arm extending from the support arm toward the housing, the actuator arm having a distal end portion joined to the support arm distally from the housing and a proximal end portion disposed in spaced relation to the housing so as to overlie the bore when viewed from a direction along the bore axis;

the actuator arm movable between a first depressed configuration where the proximal end portion is relatively closer to the housing and a second released configuration where the proximal end portion is relatively farther from the housing.

2. The flashlight holder of claim 1 wherein the proximal end portion of the actuator arm includes a protrusion oriented toward a forward portion of the housing.

3. The flashlight holder of claim 1 wherein the support arm comprises a finger loop disposed distally from the housing.

4. The flashlight holder of claim 3 wherein the finger loop includes an opening oriented transverse to the bore axis.

5. The flashlight holder of claim 1 wherein the actuator arm is supported in cantilever fashion from the support arm.

6. The flashlight holder of claim 1 wherein the housing further comprises a mounting rail angularly offset from the handle.

7. The flashlight holder of claim 1 wherein the housing includes securing means associated with the bore for releasably securing the flashlight in the bore.

8. The flashlight holder of claim 1 wherein the actuator arm is deflectable between the first depressed configuration and the second released configuration.

9. The flashlight holder of claim 1 wherein the support arm is integrally formed with the housing.

10. The flashlight holder of claim 1 wherein no part of the device is located farther from the bore axis than a distal tip of the support arm.

11. A flashlight assembly comprising:

a flashlight having a front light-emitting end and a rear power actuating end, the rear power actuating end including a power switch; and a flashlight holder including:

a housing having a bore extending along a bore axis, the bore sized and configured to receive at least the rear power actuating end of the flashlight therein; and a handle connected to the housing and comprising:

a support arm extending sideways and outward from the housing and having a longitudinal centerline oriented non-parallel to the bore axis;

an actuator arm extending from the support arm toward the housing, the actuator arm having a distal end portion joined to the support arm distally from the housing and a proximal end portion disposed in spaced relation to the pressure activated power switch so as to overlie the pressure activated power switch when viewed from a direction along the bore axis;

the actuator arm movable between a first depressed configuration where the proximal end portion is relatively closer to the housing to thereby depress the power switch and a second released configuration where the proximal end portion is relatively farther from the housing.

12. The flashlight assembly of claim 11 wherein the proximal end portion of the actuator arm includes a protrusion oriented toward the pressure activated power switch.

13. The flashlight assembly of claim 11 wherein the support arm comprises a finger loop disposed distally from the housing.

14. The flashlight assembly of claim 13 wherein the finger loop includes an opening oriented transverse to bore axis.

15. The flashlight assembly of claim 11 wherein the actuator arm is supported in cantilever fashion from the support arm.

16. The flashlight assembly of claim 11 wherein the housing further comprises a mounting rail angularly offset from the handle.

17. The flashlight assembly of claim 11 wherein the housing includes securing means associated with the bore for releasably securing at least the rear power actuating end of the flashlight in the bore.

18. The flashlight assembly of claim 11 wherein the actuator arm is deflectable between the first depressed configuration and the second released configuration.

19. The flashlight assembly of claim 11 wherein no part of the flashlight holder is located farther from the bore axis than a distal tip of the support arm, and the actuator arm mounts to the support arm proximate the distal tip in cantilever fashion.

20. A flashlight assembly, comprising:

a housing extending along a housing axis;

a light emitter supported by the housing and oriented to emit light generally along the housing axis;

a switch operative to control the light emitter;

a handle connected to the housing and comprising:

a support arm extending sideways and outward outwardly from the housing and having a longitudinal centerline oriented non-parallel to the housing axis;

an actuator arm supported by the support arm and extending toward the housing, the actuator arm having a distal end portion supported by the support arm at a location distal from the housing and a proximal end portion disposed in spaced relation to the housing so as to overlie the switch when viewed from a direction along the housing axis;

the actuator arm movable between a first depressed configuration where the proximal end portion is relatively closer to the housing and a second released configuration where the proximal end portion is relatively farther from the housing.

* * * * *